United States Patent [19]

Bessinger

[11] Patent Number: 5,069,408

[45] Date of Patent: Dec. 3, 1991

[54] SHELVING MOUNT SYSTEM

[75] Inventor: Walter L. Bessinger, Grand Haven, Mich.

[73] Assignee: Knape & Vogt Manufacturing Company, Grand Rapids, Mich.

[21] Appl. No.: 381,160

[22] Filed: Jul. 14, 1989

[51] Int. Cl.[5] ..... A47G 29/02

[52] U.S. Cl. ..... 248/250; 108/108; 211/187; 248/243

[58] Field of Search ..... 248/250, 225.2, 235, 248/243, 247; 52/36; 108/108; 211/90, 26, 134, 135, 186, 187, 153, 176

[56] References Cited

U.S. PATENT DOCUMENTS

| | | | |
|---|---|---|---|
| 290,884 | 12/1883 | Howe . | |
| 1,084,276 | 1/1914 | Jaminet . | |
| 1,983,470 | 12/1934 | Knape | 248/19 |
| 2,534,952 | 12/1950 | Comer | 248/243 |
| 2,576,865 | 11/1951 | Vanderveld | 248/243 |
| 2,678,793 | 5/1954 | Brochstein | 248/243 |
| 2,788,902 | 4/1957 | Nowicki | 211/147 |
| 3,088,424 | 5/1963 | Knuth | 108/108 |
| 3,199,822 | 8/1965 | Ruhnke | 248/243 |
| 3,265,344 | 8/1966 | Ornstein | 248/243 |
| 3,284,116 | 11/1966 | George | 287/20.92 |
| 3,295,474 | 1/1967 | Ornstein | 108/152 |
| 3,325,129 | 6/1967 | Tinfow | 248/243 |
| 3,353,684 | 11/1967 | Chesley | 211/176 |
| 3,490,393 | 1/1970 | Nelson | 108/109 |
| 3,513,786 | 5/1970 | Kellogg | 108/64 |
| 3,701,325 | 10/1972 | Fenwick | 108/1 |
| 3,984,077 | 10/1976 | Shine | 248/248 |
| 4,067,165 | 1/1978 | Timmons | 52/585 |
| 4,098,480 | 7/1978 | Neumann | 248/243 |
| 4,183,487 | 1/1980 | Swain | 248/214 |
| 4,205,815 | 6/1980 | Sauer | 52/36 X |
| 4,327,838 | 5/1982 | Cooke | 211/184 |
| 4,429,850 | 2/1984 | Weber | 248/250 |
| 4,431,155 | 2/1984 | Engel | 248/243 |
| 4,615,163 | 10/1986 | Curtis et al. | 52/703 |
| 4,624,376 | 11/1986 | Bertram | 211/187 |
| 4,641,469 | 2/1987 | Wood | 52/309 |
| 4,658,969 | 4/1987 | Mastrodicasa | 211/187 |
| 4,796,845 | 1/1989 | Regel | 248/243 |

FOREIGN PATENT DOCUMENTS

| | | | |
|---|---|---|---|
| 1289272 | 2/1969 | Fed. Rep. of Germany . | |
| 8302767 | 3/1985 | Netherlands | 248/243 |

OTHER PUBLICATIONS

Knape & Vogt catalog KV 72-PB, pp. A13, A14 & A15.

Xerographic copy of "Fastex" brand plastic pop rivet.

Knape & Vogt Sales Literature (2 pages).

*Primary Examiner*—J. Franklin Foss

*Attorney, Agent, or Firm*—Price, Heneveld, Cooper, DeWitt & Litton

[57] ABSTRACT

A shelving assembly having vertical standards and cantilever brackets, and an elongated generally U-shaped cover over each standard. The cover flanges laterally stabilize the bracket. The brackets have V-shaped upper recesses interfitting with slotted hemispherical shelving mounts fitted in the upper edge recesses of the brackets, each mount having a tapered slot configuration complementary to the recess configuration, and having an upper adhesive pad and a vertical jack for temporarily holding a shelf up off the adhesive. The jacks are shiftable down under limited predetermined force to lower the shelf onto the adhesive for anchoring.

19 Claims, 4 Drawing Sheets

SHELVING MOUNT SYSTEM

BACKGROUND OF THE INVENTION

This invention relates to shelving systems employing vertical slotted standards that mount to the wall and have cantilever brackets attached thereto. Such systems typically are employed for utility purposes as in home workshops, recreation rooms, children's bedrooms, garages and the like, and far less frequently in rooms of the house containing special furniture, or in office areas. This is largely because these known systems typically do not have a finished "dress" appearance due to the coarse hardware being visible.

The cantilever brackets for this equipment are typically made of stamped steel plate stock attached to the standards by hooked lugs on one end of the brackets. A further disadvantage of such brackets is potential side sway. In order to limit side sway of such brackets under load, the brackets have previously been provided with special features such as a transverse clip as in U.S. Pat. Nos. 1,983,470 to J. J. Knape and 3,135,491 to H. F. Knape et al, or use of double brackets for each standard. If the brackets are allowed to move laterally, the shelves will also move. This is undesirable. Additionally, with some structures the shelf can be moved relative to fixed brackets. This can result in accidental shelf spillage. Prior devices have been developed so that the shelf is supported on saddle type clips on the brackets (see for example U.S. Pat. No. 3,199,822) or attached by adhesives (see for example U.S. Pat. No. 3,265,344). This latter feature adds some stability. However, assembly of such can be difficult and frustrating because the adhesive tends to lock the shelf in place where it is initially positioned, even though this may not be the desired final position.

These and other shortcomings are known to those in the art of cantilever shelving.

RELATED APPLICATIONS

This application is related to copending applications Ser. No. 07/381,149, filed July 14, 1989, entitled AESTHETIC SHELVING SYSTEM; Ser. No. 07/381,160, filed Apr. 14, 1989, entitled INTERLOCK SHELVING BRACKET AND STANDARD COVER; Ser. No. 07/381,108, filed July 4, 1989, entitled BEAM AND TELESCOPIC CONNECTOR SHELVING SYSTEM; Ser. No. 07/381,122, filed July 14, 1989, entitled BOOK END BRACKET AND SHELVING SYSTEM; and Ser. No. 07/381,150, filed July 14, 1989, entitled PIN AND CLIP SHELF MOUNTING.

SUMMARY OF THE INVENTION

The present invention provides a novel shelving system wherein the shelves are supported on special mounts attached to the brackets in configurated recesses. The shelves are ultimately adhered to the mounts. The adhesive action, however, does not occur until the shelf is positioned in its final desired location and the shelf shifted downwardly to activate the adhesive. This is achieved by the special mounts having shiftable jacks that hold the shelf elevated until the final position is achieved. The mounts provide substantial support as well as aesthetic appeal.

These and other advantages and features will become apparent to those in this art upon studying the detailed disclosure.

DESCRIPTION OF THE PREFERRED EMBODIMENTS

Figure 1:
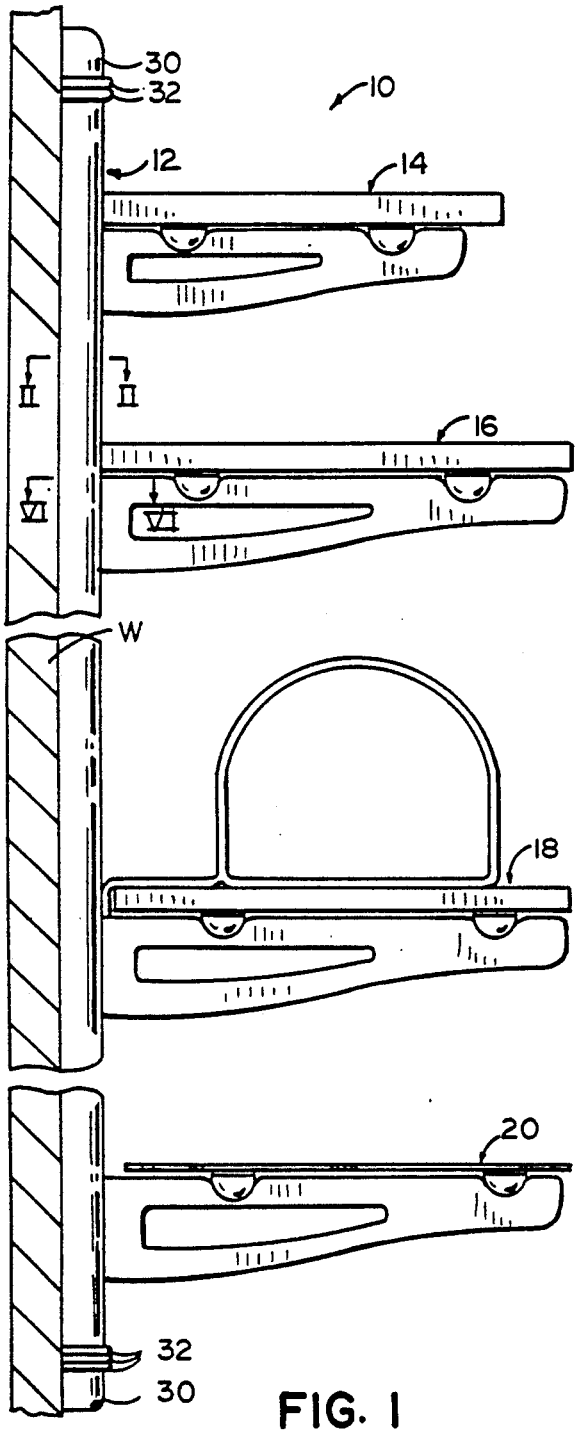
FIG. 1 is an elevational view showing the invention relative to four different shelf arrangements on standards.
Figure 4:
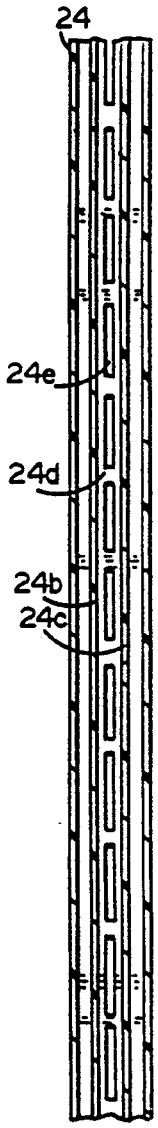
FIG. 4 is a sectional view taken on plane IV—IV of FIG. 3.

In FIG. 1 is disclosed a shelving assembly 10 comprising vertical standard subassembly 12 and four representative shelf and bracket subassemblies 14, 16, 18 and 20.

Figure 7:
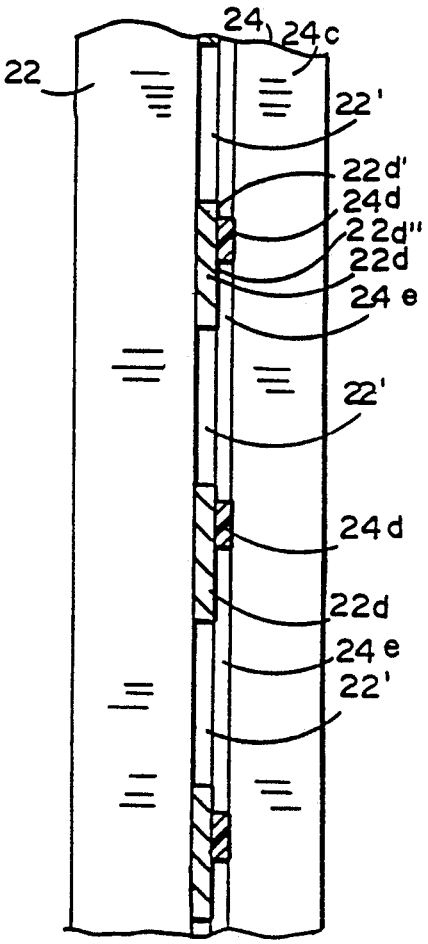
FIG. 7 is a sectional view taken on plane VII—VII on FIG. 5.
Figure 10:
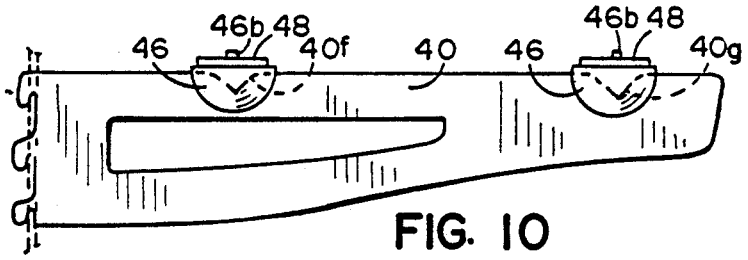
FIG. 10 is a side elevational view of a bracket and a pair of hemispherical mounts prior to placement of a shelf thereon.
Figure 11:
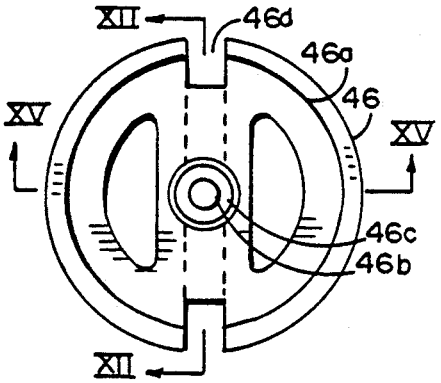
FIG. 11 is a top plan view of one of the mounts in FIG. 10 prior to insertion of the adhesive pad.

Standard subassembly 12 comprises a conventional generally U-shaped upright vertical standard 22 (FIG. 2) having a front face 22*a*, normally flat, and a pair of side faces 22*b* and 22*c* spaced from each other and typically parallel to each other. The U-shaped structure is integral, being formed of metal such as steel, aluminum or the like. Front face 22*a* has a plurality of vertically spaced, vertically elongated slots 22' for receiving connecting lugs of shelf brackets in manner to be described hereinafter. Between these slots are transverse webs 22*d* behind which the lugs engage (FIG. 7).

Figure 2:
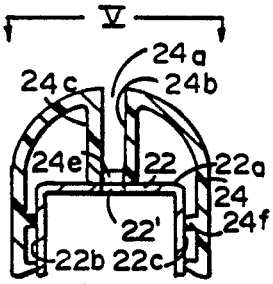
FIG. 2 is a sectional view of a shelf support standard and its cover taken on plane II—II of FIG. 1.
Figure 5:
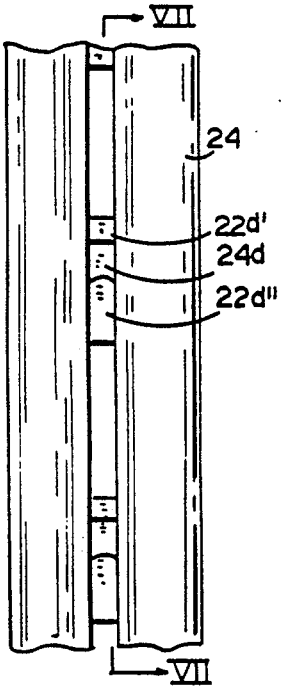
FIG. 5 is an enlarged view taken in the direction V in FIG. 2.
Figure 6:
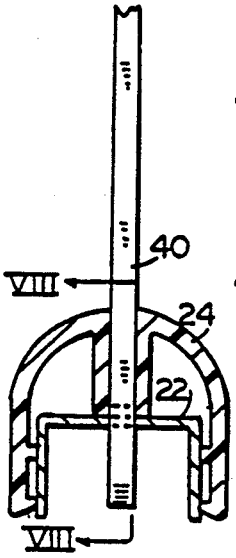
FIG. 6 is a fragmentary sectional view taken on plane VI—VI of FIG. 1.

Standards 22 are mounted in conventional fashion to a fixed vertical support, usually a wall W, as by screws extending through openings (not shown) provided in the standard, for securement in spaced parallel fashion to the wall W (FIG. 1). Encompassing at least the front face and the side faces of standard 22 is a resilient polymeric dress and stabilizing cover 24, herein called simply a dress cover for convenience. Dress cover 24 is generally U-shaped in configuration, preferably having a convexly curved front with a central outer apex and a pair of side legs 24*g* and 24*h* extending rearwardly from the apex past the front face of standard 22 to engage the side faces thereof as well as cover all three faces. At the front apex of cover 24, which is spaced forwardly from the standard front face 22*a*, is a vertically elongated space 24*a* basically extending the length of the cover. This space extends inwardly between a pair of vertically elongated side flanges 24*b* and 24*c*. These flanges are integral with the remaining portions of the cover and extend from the outer apex inwardly toward the front face of standard 22 where they engage the standard and are interconnected by a plurality of vertically spaced transverse webs 24*d* (FIG. 5). These webs are spaced by intermediate vertically elongated slots 24*e* (FIG. 2). Slots 24*e* of the cover are longer than standard slots 22' as will be explained more fully hereinafter. Webs of the cover are shorter than webs of the standard. Each of the legs of dress cover 24 includes a pair of ribs 24*f* on the inside face thereof to engage standard side faces 22*c* and 22*b*. Cover 24 projects in front of standard 22 at least about double the thickness, from front to back, of the standard. The slots in the standard and in the cover are therefore recessed considerably to not normally be visible except to someone looking directly into the slot at close range. The result is aesthetically pleasing a well as structural stability.

Figure 3:
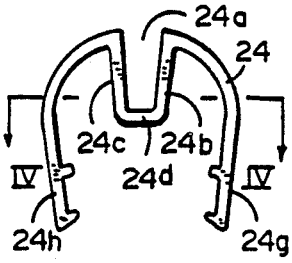
FIG. 3 is a top plan view of the cover component in FIG. 2, but in its freestanding form not connected to the standard.

In its free state, dress cover 22 preferably appears as in FIG. 3, i.e., with its legs canted toward each other rearwardly from the apex, in response to an inherent resilient bias. Flanges 24*b* and 24*c* have a resilient bias away from each other, thus extending divergently outwardly, i.e., forwardly from the transverse webs 24*d* to the outer front apex of member 24. The space in between the free rear ends of the legs of member 24 is less than the spacing of side faces 22*a* and 22*b* of standard 22 from each other, so that the legs must be spread against the inherent resilient bias of the cover member 24 when placing it over the standard. This spread against the inherent resilient bias causes the legs, and particularly ribs 24*f* thereof, to subsequently squeeze and grip the standard side faces for retention. When these legs are spread, this also causes flanges 24*b* and 24*c* to move toward each other to a spacing equal to or slightly less than the thickness of the plate type brackets to be connected to the standard. Cover 24 is preferably of polymeric material such as polystyrene or the equivalent formed a by extrusion. It can be any of a multiple of colors and have various surface characteristics such as grooves, ribs, scallops, striations, etc.

The stabilizing cover just described is preferred. However, a stabilizing cover with less than all of these characteristics could be employed, such as a dual durometer cover with relatively fixed legs spaced apart an amount slightly greater than the width of the standard, and having flexible resilient ribs at 24*f* for flexibly gripping the standard side walls. Such a cover could be made of polyvinylchloride (PVC), for example, with the ribs of a different durometer than the main body.

Figure 20:
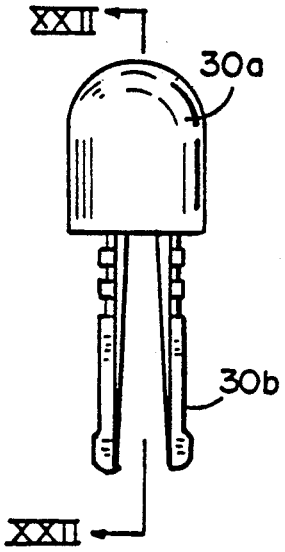
FIG. 20 is a front elevational view of a dress cap at the upper and lower ends of the standard structure in FIG. 1.
Figure 21:
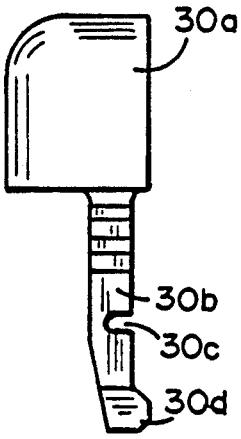
FIG. 21 is a side elevational view of the cap in FIG. 20.
Figure 22:
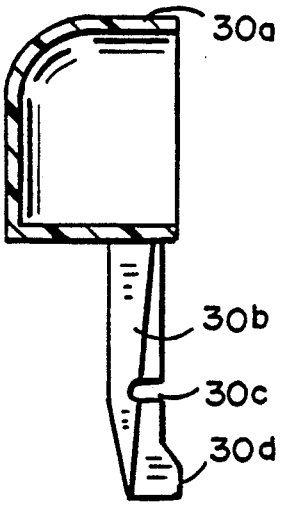
FIG. 22 is a sectional view taken on plane XXII—XXII of FIG. 20.

The structure in FIG. 1 is shown to include caps and decorative collars at the upper and lower ends of the standards. The individual caps are preferably shaped compatible with the configuration of dress cover 24 but can be a variety of configurations. That shown in the drawings is slightly elongated. However, this cap could be spherical in shape or have some other configuration and/or special surface decoration. Surface decorations such as scallops, ribs or ridges of various selected size and shape may be applied to cover member 24 as well as the caps. Each upper and lower cap 30 is shown to include the exposed dress portion or head 30*a* (FIGS. 20–22) and also a pair of depending spring legs integral with the head and insertable between the wall surface and the front wall of standard 22. The caps and legs can be molded in one piece. Legs 30*b* include cutout flex areas 30*c* therein, intermediate their length, and laterally protruding, wall engaging feet 30*d*, so that insertion of the legs into the upper and lower ends of standard 22 causes engagement of feet 30*d* with the wall, and of the knee portion of the legs with the inside surface of the standard front, to apply flexing action about cutouts 30*c*. This causes resilient connection friction of the legs on the wall and standard at the ends of the cover to hold the caps in place. The outer two surfaces of legs 30*b* include horizontal grooves to receive one or more (here shown to be three) collars. Two of such collars are depicted at the top of FIG. 1, and three at the bottom as examples. If no collars are used, the caps just abut squarely against the upper edge of cover 24. If one or more collars are used, the cap abuts against a collar, and a collar abuts the end of the cover.

Figure 23:
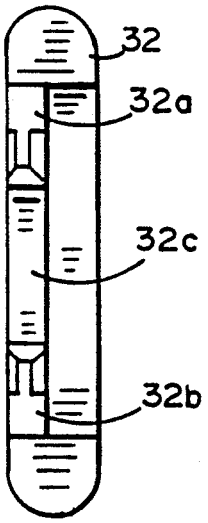
FIG. 23 is a rear elevational view of a decorative collar at the top and the bottom of the structure in FIG. 1.
Figure 24:
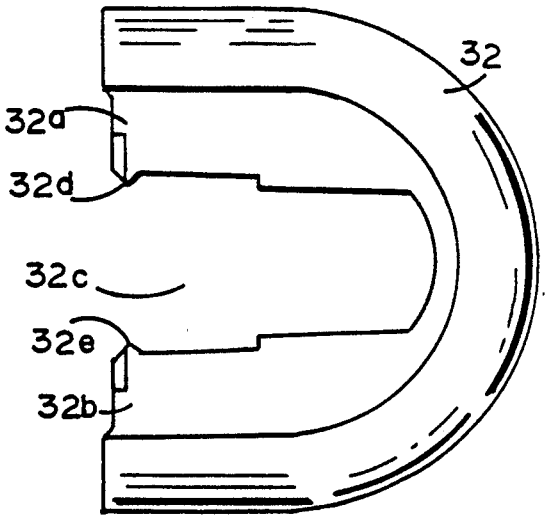
FIG. 24 is a plan view of the collar in FIG. 23.

Connection of collars 32 (FIGS. 23–24) is readily achieved by placing these in horseshoe fashion about the spring legs 30*b* of the cap. Each collar 32 has a pair of flanges 32*a* and 32*b* (FIG. 24) straddling a slot 32*c* therebetween. This slot includes an enlarged portion near the opening, and a pair of facing protrusions 32*d* and 32*e* for engaging behind spring legs 30*b* of cap unit 30. The selected number of collars is therefore positioned on the spring legs by pressing the collar against the front of the legs, causing the legs to momentarily be shifted toward each other against the bias inherent in the polymeric structure until the legs snap back into the outer enlarged space of slot 32*c*.

Connection of a bracket to a standard will be understood best from FIGS. 5–9. The shelf support bracket 40 or 140 is basically a plate member formed in conventional manner from flat plate stock. Each bracket has at least two vertically spaced lugs at one end for connection to like vertically spaced transverse webs 22d between the vertical slots 22' of the standard. Each of the four exemplary shelf subassembly variations depicted in FIG. 1 employs two plate type brackets having at least two lugs on the rear of the bracket. The top unit 14 in FIG. 1 has a shorter length bracket, e.g., a seven inch long bracket with a wood shelf thereon; the second unit 16 has a longer and larger bracket with a wider shelf thereon; the third unit 18 has such a bracket and shelf with a book end attached thereto; and the fourth unit 20 has a bracket supporting a thinner shelf as of glass.

Figure 8A:
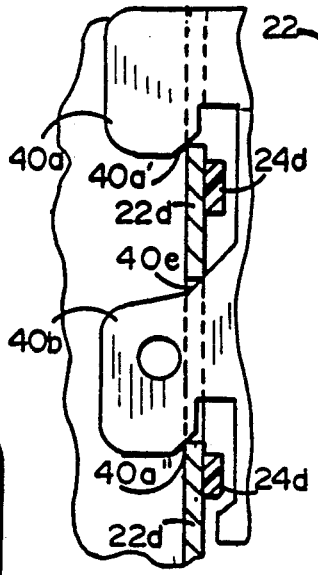
FIG. 8A is a sectional view of the structure in FIG. 8, showing interengagement of the bracket and standard occurring under the influence of direct vertical force applied to the shelf and/or bracket.
Figure 8:
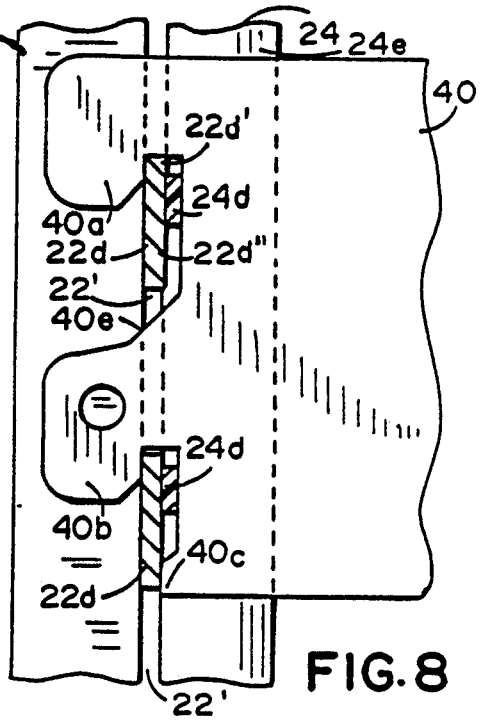
FIG. 8 is a sectional view comparable to FIG. 7 but with a two lug bracket attached to the standard

Insertion of bracket 40 into the elongated space 24a of cover 24 causes the cover flanges 24b and 24c to grip the side walls of this bracket due to the inherent resilience of the cover legs toward each other, and also the inherent resilient of the junctures of flanges 24b and 24c with cross webs 24d. The cover extends in front of the standard an amount about equal to the depth of the standard so that flanges 24b and 24c have a substantial area of contact with the bracket. Therefore, when the bracket is attached to the standard, cover 24 provides significant lateral stability to inhibit lateral movement of the bracket. Each of the bracket lugs, e.g., upper lug 40a and lower lug 40b on a two lug bracket (FIG. 8) extends rearwardly from the one end of the bracket body, and specifically the bracket rear edge, and then downwardly to engage behind webs 22d. The forward surfaces of these lugs are spaced rearwardly from the rear bracket edge an amount at least equal to substantially the combined thickness of standard web 22d and cover web 24d, whereby this space may receive both webs therein as depicted in FIG. 8. Preferably, when the upper lug is engaged down flush against the upper edge of a web 22d with which it is cooperative, lower lug 40b will be spaced slightly, e.g. approximately 0.015 of an inch or so above the web 22d adjacent it, to assure secure interengagement between the upper lug and its web since most of the tensile stress occurs at upper lug 40a. Preferably, there is also a clearance between the upper edge of polymeric web 24d and the upper lug, i.e., an exposed area 22d' adjacent the top of web 22d, to prevent the lug 40a from bottoming out on the resilient polymeric web 24d. Such an occurrence could prevent the most secure mounting of the bracket. Also, the extra length of the cover slots 24e relative to the length of standard slots 22', i.e., the fact that polymeric web 24d is shorter than metal web 22d, allows an exposed area 22d'' at the base of web 22d. Cooperative with this exposed area is a rearwardly projecting abutment 40c at the bottom portion of bracket 40, i.e., below lower lug 40b (FIG. 8). This abutment 40c is spaced forwardly from lug 40b an amount equal approximately to the thickness of web 22d, but offset below it. This causes the compressive load on the bracket to be applied directly against the metal web rather than the polymeric web, for stability.

Extending diagonally upwardly from the upper edge of lower lug 40b to the rear edge of the bracket body is an upwardly forwardly sloping surface 40e. This serves at least two functions. Firstly, during insertion of the bracket lugs, engagement of surface 40e with the lower edge of web 22d thereabove acts as a camming surface to cause the bracket to move downwardly into position with the lugs behind the webs. Seondly, once installed, the bracket cannot readily be accidentally dislodged by upward vertical force on the bracket and/or shelf since the throat area between surface 40e on the lower lug and the correspondingly sloped, generally parallel surfaces 40a' and 40a'' (FIG. 8A) on the bottom of lug 40a thereabove is approximately the height of web 22d and if measured diagonally, upwardly-rearwardly, is less than the height of this lug. Like sloped surface 40a'' on lug 40b engages the upper rear edge of a web 22d simultaneously with surface 40a' engaging another web 22d. Thus, simple vertical movement of bracket 40 will not dislodge it from the webs, nor vertical movement plus counterclockwise rotation. Rather it must be lifted and simultaneously pulled forwardly away from the standard to disconnect the bracket from the standard.

Figure 9:
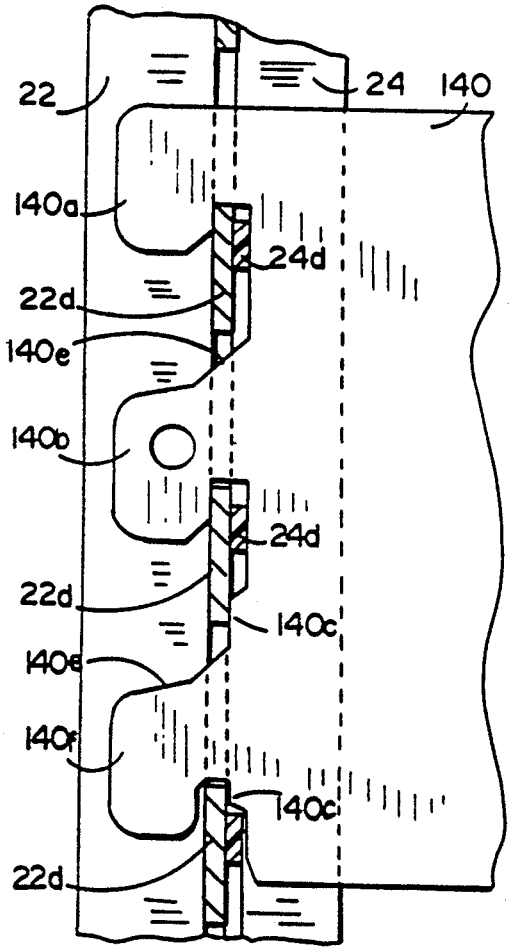
FIG. 9 is a sectional view comparable to that in FIG. 7 but with a three lug bracket attached to the standard.

In FIG. 9 is depicted a three lug bracket 140. Upper lug 140a and intermediate lug 140b are comparable to upper lug 40a and lower lug 40b in FIG. 8. Abutment 140c is comparable to abutment 40c in the two lug bracket, engaging the exposed area of a web 22d as an auxiliary abutment. Beneath these two lugs is a third lug 140f which engages behind a third web 22d of standard 22. Preferably lowermost lug 140f has a clearance between its front face and the rear face of web 22d, to assure full abutment between upper lug 140a and its cooperative web. An additional primary abutment 140c' can be provided adjacent the third lug to engage, for example, the upper exposed portion of its adjacent web 22d. The spacing between each lug and the rear edge area of the body of bracket 140 accommodates the combined thicknesses of the standard web and the cover web as explained heretofore.

Figure 12:
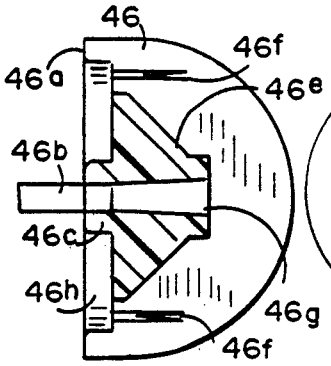
FIG. 12 is a sectional view taken on plane XII—XII of FIG. 11.
Figure 13:
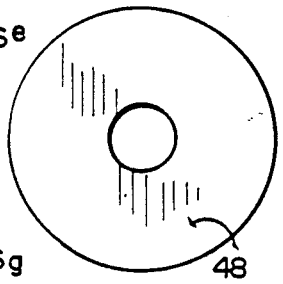
FIG. 13 is a plan view of the adhesive pad to be placed on the mount.
Figure 14:
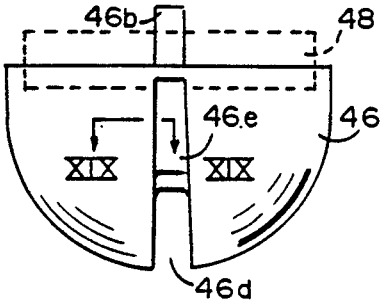
FIG. 14 is an end elevational view of the mount in FIGS. 10-12, showing the adhesive pad in hidden lines.
Figure 15:
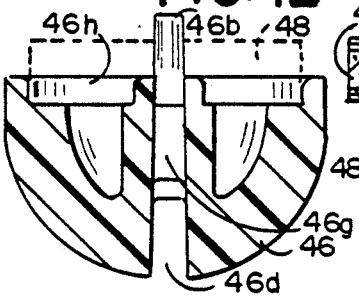
FIG. 15 is a sectional view taken on plane XV—XV in FIG. 11.

Combined with each bracket are at least two mounts 46, the preferred form of which is depicted in FIGS. 10–19. Bracket 40 includes a pair of generally V-shaped recesses in its upper edge to interfit with these mount elements. These two generally V-shaped recesses 40f and 40g are spaced from each other along the length of the bracket. Positioned at these recesses is a pair of mounts 46. These mounts are preferably hemispherical in configuration having a generally flat circular upper portion to receive a flat circular adhesive disc 48. This disc is preferably of a foam polymeric material to have limited compressibility. It rests in a top recessed surface or cavity 46h of the mount, surrounded by an upper rim 46a (FIG. 12). Disc 48 extends a small amount above rim 46a. It has a central opening to fit around a center jack 46b to be described hereinafter and a hub 46c around the jack. An arcuate slot 46d extends around the lower periphery of mount 46. At the central base of this slot is a generally V-shaped mating surface 46e configurated generally like the substantially V-shaped recesses 40f and 40g, to rest on the edges of these recesses while straddling bracket 40. This slot preferably includes deformable means such as a pair of small crush ribs 46f (FIG. 19) which can be deformed when the mount is forced down into its straddling position onto plate bracket 40, assuring a tight friction fit. This mount, including the crush ribs and the central connector 46e as well as vertically extending jack 46b, are preferably formed of polymeric material integrally molded in one piece. As molded, the lower edge of cylindrical jack 46b is connected by a peripheral frangible web 46b' (FIG. 16) at its base between hub 46c and the base of jack pin 46b. This frangible juncture can be broken by downward force of a predetermined amount on jack 46b, at which time the lower portion of jack 46b is moved part way down into an underlying and surrounding channel or cavity 46g (FIG. 12 and FIG. 18) with a friction fit. Also, the frangible juncture (flash) on the jack is carried into the surrounding channel or cavity 46g to enhance this friction fit. In this position, the jack still projects above the adhesive surface of disc 48. This friction fit can be overcome by a second lesser predetermined force for purposes to be described.

Figure 18:
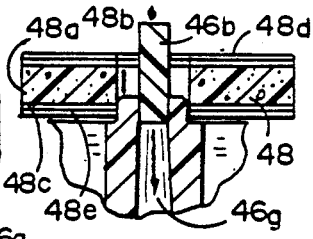
FIG. 18 is an enlarged fragmentary sectional view of the mount with an adhesive pad thereon.
Figure 19:
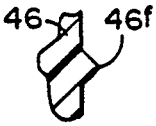
FIG. 19 is a greatly enlarged fragmentary sectional view of a crush rib, taken on plane XIX—XIX of FIG. 14.
Figure 16:
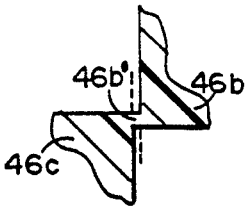
FIG. 16 is a greatly enlarged fragmentary sectional view of an initial juncture in the device of FIG. 12.

Breakage of the frangible connection can be performed at the molding dies or subsequently. It is anticipated that application of the first larger predetermined force to break frangible joint 46*b'* will be performed by the injection mold at the manufacturer, or someone else prior to the ultimate purchaser, although it could conceivably be performed by the purchaser. This causes the jack pin 46*b* to shift from the position illustrated in FIG. 12 to that illustrated in FIG. 17. In this second condition, the jack pin is still elevated above the upper adhesive surface of pad 48 as noted above. It can be lowered further by lesser predetermined force because such need only overcome the friction between the jack pin and its recess or cavity 46*g*. In FIG. 18 the mount is shown having received the adhesive pad member 48. Although it is illustrated with the foam polymer central layer 48*a* with its upper and lower adhesive layers 48*b* and 48*c* covered by separable protective layers 48*d* and 48*e*, respectively, typically these protective layers would have been removed when the pad is placed on hub 46*c* around jack pin 46*b*.

In this preferred embodiment of the mount, the jack is a centrally located pin. Alternatively, it could be a downwardly shiftable projection of another configuration and/or location on the mount, such as an upwardly projecting cylindrical ring, plug, spherical element, pivotal link or other device projecting above the adhesive surface and depressible under predetermined force to a lowered position at or below the adhesive surface.

Figure 25:
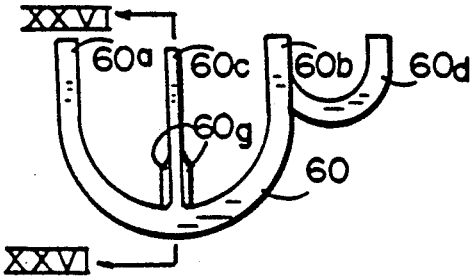
FIG. 25 is a plan view of a wire clip for the assembly.
Figure 26:
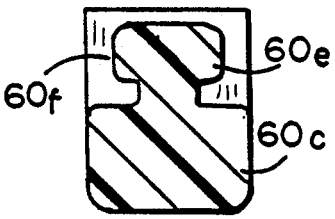
FIG. 26 is a greatly enlarged fragmentary sectional view connector portion of the clip in FIG. 25.

In FIGS. 25 and 26 is also disclosed a wire clip which constitutes a generally U-shaped body 60 with a pair of spaced legs 60*a* and 60*b* that can straddle cover element 24 at a selected location. Several of these can be placed at spaced vertical intervals on cover 24. Extending from the center of this body, inwardly, generally parallel to the terminal portions of legs 60*a* and 60*b*, is a connector element 60*c* which has upper and lower lugs 60*e* and 60*f* symmetrically on the upper and lower edges thereof to allow this member to be attached to the standard in either of two 180° rotational positions. Extending from one side of this member, i.e,. from leg 60*b*, is a generally U-shaped wire retention element 60*d* enabling an electrical wire to be positioned therein. Thus, wiring can be run alongside the standard. By rotating the clip 180°, the wire can be held on either side of the standard. Optionally, this member may also include a pair of crush ribs 60*g*. The member is preferably formed of polymeric material. These ribs will therefore provide a friction fit with flanges 24*b* and 24*c* of cover 24 when connector element 60*c* is slid between them, as well as on of lugs 60*e* and 60*f* engaging behind a web 22*d* of standard 22.

Assembly of the shelving apparatus is relatively straightforward and easy. At least two of the vertical standards 22 are spaced from each other at predetermined distances, each vertically oriented and parallel to the other, and then mounted to a wall in conventional manner as by screws (not shown). The cover is then ready to be installed on each standard. Cover element 24 in its freestanding form (FIG. 3) is resiliently deformed by spreading its legs to the width of standard 22 and sliding it over the standard so that ribs 24*f* tightly engage outer faces 22*b* and 22*c* of the standard. This cover is pressed onto the standard until webs 24*d* bottom out against the front face 22*a* and slots 24*e* are generally aligned with but longer than slots 22' of the standard. Spreading of the legs of the cover enables it to frictionally grip the outer sidewalls of the upright standards as well as closing space 24*a* to an amount slightly less than the width of the bracket body. The differential length of the slots as well as the corresponding webs causes exposed areas of the standard webs at least below, and preferably above and below, cover webs 24*d* as at 22*d'* and 22*d''* (FIGS. 5, 7 and 8). Typically the cover will be the same length as the standard so that alignment of the ends thereof will cause proper positioning of the corresponding slots and corresponding webs. Additional indicia may also be provided on the cover to aid in its orientation and position on the standard. As examples, one end of the cover slots could be of different shape, one end of the cover could have markings, etc.

At this time, caps 30 and the selected number of collars 32 are placed at the upper and lower ends of the covers. Spring legs 30*b* are inserted into the space defined between the wall and the standard, with feet 30*d* of the spring legs engaging the wall and the knees engaging the standard to apply a flexing force about cavities 30*c* for securely retaining the caps in position. The brackets are then ready to be placed into engagement with the other components.

More specifically, the lugs extending from the rear end of the bracket body are forceably inserted through the vertically elongated space 24*a* such that the bracket sidewalls have a friction fit with flanges 24*b* and 24*c*. The lugs also extend through the elongated slots of the cover and the adjacent elongated slots of the web, after which downward inward pressure is applied to the bracket to cause lugs 40*a*, 40*b* or 140*a*, 140*b* and 140*f* to engage behind the standard webs 22*d*. The brackets lock cover 24 in position, as well as the cover stabilizing the brackets. If desired, the spacing between the front edge of the lugs and the rear edge of the bracket body can cause the polymeric webs 24*d* to be put under some compression. The resulting increased frictional resistance to removal of the bracket can be advantageous. These polymeric webs can have a slight convexity, i.e., crown, such that this insertion of the bracket flattens out the crown to apply compression against the rear edge of the bracket body. This insertion of the bracket is aided by camming surface 40*e* on the two lug bracket and camming surfaces 140*e* on the intermediate and lower lug of the three lug bracket (FIG. 9). These same surfaces prevent inadvertent vertical movement of the bracket from the standards by a vertical force accidentally applied to the outer end of the brackets because of the restricted throat area between the lugs relative to the height of the standard webs (FIG. 8A). Yet, the brackets can readily be moved vertically and forwardly to purposely release them. After a pair of brackets are securely inserted at the same level in the pair of standards, a pair of mounts 46 is placed on and astraddle of each bracket. Each mount is positioned in a corresponding recess 40*f* such that the support surfaces 46*e* engage the correspondingly configurated edges of recess 40*f*.

Figure 17:
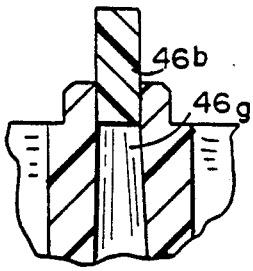
FIG. 17 is a greatly enlarged fragmentary sectional view of the upper central portion of the mount in FIGS. 10 et seq. subsequent to breakage of the juncture and prior to placement of a shelf thereon.

At this point, jack 46*b* may have had its frangible joint 46*b'* previously broken loose from hub 46*c* so as to be partially lowered into the position illustrated in FIG. 17, but its upper end still above the adhesive surface. Such an adhesive surface is provided by placing the foam disc 48 having adhesive on both surfaces thereof onto the top flat portion of the hemispherically shaped mount 46, i.e., into recess 46*h*. The lower adhesive surface of the disc anchors the disc to the mount. A shelf is then placed upon the four upstanding jacks 46*d* of two spaced parallel brackets. The shelf will not contact the adhesive at this point so that it can be readily shifted about to the desired final position. Once so located, a small predetermined downward force is applied to the shelf to shift jack pins 46*b* down into their cavities or channels 46*g*, allowing the bottom surface of the shelf to engage the upper adhesive surface on the discs at the top of each mount. The shelf is thus secured in position.

Any inadvertently applied lateral force on the shelf will tend to be overcome because of the adherence of the shelf to these mounts, the placement of the mounts in the recesses, and the stabilizing effect of cover 24 on brackets 40 against lateral forces. Likewise, inadvertently applied vertical fores on the outer edge of the shelf will be resisted by the adhesion of the shelf to the mounts, the mounts to the brackets, and the inability of the bracket lugs to be released from their standard slots unless a combined forward and upward movement is purposely applied.

In addition to the many features and advantages specifically noted above, those skilled in the art, upon studying this disclosure, may perceive of other advantages to be gained. Further, certain variations can be made in the individual components of this assembly without departing from the concept of the invention which is illustrated by the preferred embodiment depicted. It is not intended that the invention is to be limited to this specific illustrated preferred embodiment, but rather only by the scope of the appended claims and the reasonably equivalent structures to those defined therein.

The embodiments of the invention in which an exclusive property or privilege is claimed are defined as follows:

1. A shelving standard and bracket assembly comprising:

vertical standards to be mounted to a wall in spaced parallel relationship to each other;

said standards each having a front face and a pair of spaced side faces;

said front face having a plurality of vertically spaced slots and intermediate webs for attachment of the lugs of cantilever brackets thereto;

cantilever brackets having lugs extending through said standard slots to anchor on said webs;

said brackets having recesses in the top thereof;

shelving mounts supported in said bracket recesses, each mount having an upper portion to retain an upwardly facing adhesive surface to engage a shelf placed on said brackets;

a shelf-elevating jack projecting upwardly from said mount and extending above an adhesive surface on said upper portion to temporarily retain a shelf above the adhesive surface;

said jack being shiftable downwardly under force to allow a shelf to be lowered onto the adhesive surface.

2. The assembly in claim 1 wherein said jack is a vertical projection, said mount has a channel receiving the lower portion of said projection, and said projection is shiftable downwardly in said channel.

3. The assembly in claim 1 wherein said jack is frictionally movable in said mount under a predetermined friction-overcoming force.

4. The assembly in claim 1 wherein said mount is molded polymer, said jack is made integral with said mount by a connector, and said mount has a channel beneath said jack to receive the lower portion of said jack when predetermined connector-breaking downward force is applied to said jack to release said connector and at least partially lower said jack.

5. The assembly in claim 4 wherein said jack is a polymeric molded projection formed integrally with said mount;

said connector is a frangible juncture; and said mount has a slotted underside to fit over said cantilever bracket.

6. The assembly in claim 5 wherein breakage of said frangible juncture allows partial lowering of said projection, and said projection is then subsequently lowered further by application of a predetermined friction-overcoming force.

7. The assembly in claim 5 wherein said slotted underside comprises a slot having a slight taper to readily receive said bracket.

8. The assembly in claim 5 wherein said slotted underside comprises a slot having a deformable polymeric means in said slot for causing tight gripping of said mount on said bracket.

9. The assembly in claim 8 wherein said means comprises crush ribs.

10. The assembly in claim 4 including an adhesive surface layer on said mount upper portion, with a central opening therein for extension of jack upwardly therethrough.

11. A mount for supporting a shelf on cantilever brackets comprising a body having an upper means for retaining an upwardly facing adhesive surface to engage a shelf placed on said brackets;

a shelf-elevating jack projecting upwardly from said mount and extending above an adhesive surface on said upper portion for temporarily retaining a shelf above the adhesive surface;

said jack being shiftable downwardly under predetermined force to lower the shelf onto the adhesive surface; and said mount having a slotted underside for straddling a cantilever bracket.

12. The mount in claim 11 including an adhesive surface layer on said mount upper means, with a central opening therein for extension of said jack upwardly therethrough.

13. The mount in claim 11 wherein said slotted underside comprises a slot having a deformable polymeric means in said slot for causing tight gripping of said mount on said bracket.

14. The mount in claim 13 wherein said means comprises crush ribs.

15. A cantilever shelf bracket and shelf mount subassembly comprising:

a plate-type bracket having connector means at one end for attachment to a standard, and having an upper edge;

configurated recesses in said upper edge, each said recess having a generally V-shaped configuration;

shelf support mounts in said recesses, each said mount having an upper shelf support surface, and having a slot in the bottom thereof for receiving said bracket upper edge, said slot having a pair of side walls and a base, said base having its lowest portion in the central region of said slot, and extending diagonally upwardly and outwardly therefrom to interfit with said V-shaped grooves;

said mounts each having an upper adhesive layer and each of said mounts including a shelf elevating jack projecting upwardly from said mount and above said adhesive layer to temporarily retain a shelf above said adhesive layer, and being shiftable downwardly under a predetermined force to lower the shelf onto said adhesive layer.

16. The subassembly of claim 15 wherein said mounts are hemispherical in shape.

17. The subassembly in claim 15 wherein said jack is a pin and said mount includes a channel frictionally engaging said pin.

18. The subassembly in claim 15 wherein said slot has a deformable means deformable by insertion of a bracket in said slot for causing tight gripping of the bracket.

19. The subassembly in claim 18 wherein said means comprise crush ribs.

* * * * *

UNITED STATES PATENT AND TRADEMARK OFFICE

CERTIFICATE OF CORRECTION

PATENT NO. : 5,069,408

DATED : December 3, 1991

INVENTOR(S) : Walter L. Bessinger

It is certified that error appears in the above-identified patent and that said Letters Patent is hereby corrected as shown below:

Column 3, line 54:
"a well as" should be --as well as--.

Column 4, line 7:
"a by" should be --as by--.

Column 5, line 64:
"seondly" should be --secondly--.

Column 7, line 15:
After "by" insert --a--.

Column 7, line 31:
After "under" insert --a--.

Column 7, line 54:
"on of" should be --one of--.

Column 9, line 16:
"fores" should be --forces--.

Column 10, line 28:
"of jack" should be --of said jack--.

UNITED STATES PATENT AND TRADEMARK OFFICE

CERTIFICATE OF CORRECTION

PATENT NO. : 5,069,408

DATED : December 3, 1991

INVENTOR(S) : Walter L. Bessinger

It is certified that error appears in the above-identified patent and that said Letters Patent is hereby corrected as shown below:

Column 11, line 9:
"of claim" should be --in claim--.

Signed and Sealed this

Seventh Day of September, 1993

Bruce Lehman

*Attest:*

BRUCE LEHMAN

*Attesting Officer*

*Commissioner of Patents and Trademarks*